US005353983A

United States Patent [19]

Miller

[11] Patent Number: 5,353,983

[45] Date of Patent: Oct. 11, 1994

[54] BEVERAGE CONTAINER

[76] Inventor: Ronald A. Miller, 2223 Valley Mill, Carrollton, Tex. 75006-1909

[21] Appl. No.: 176,531

[22] Filed: Jan. 3, 1994

[51] Int. Cl.[5] ..... B65D 5/74

[52] U.S. Cl. ..... 229/103.1; 215/1 A; 220/705; 220/710

[58] Field of Search ..... 229/103.1; 215/1 A; 220/705, 710; 222/527, 530, 534, 536, 538, 541

[56] References Cited

U.S. PATENT DOCUMENTS

| | | | |
|---|---|---|---|
| 2,057,812 | 10/1936 | Aramendia | 222/534 |
| 3,171,573 | 3/1965 | Berney | 222/534 |
| 3,473,703 | 10/1969 | Lippincott | 222/541 |
| 3,486,679 | 12/1969 | Pfahler | 229/7 |
| 3,717,476 | 2/1973 | Harvey | 99/138 R |
| 3,774,804 | 11/1973 | Henning | 220/90.2 |
| 4,318,403 | 3/1982 | Sneider | 222/538 |
| 4,356,927 | 11/1982 | Cooper et al. | 220/90.2 |
| 4,441,640 | 4/1984 | Lottick | 224/252 |
| 4,462,503 | 7/1984 | Di Raffaele et al. | 220/90.2 |
| 4,573,631 | 3/1986 | Reeves | 229/103.1 |
| 4,830,204 | 5/1989 | Lin | 215/1 A |
| 4,982,854 | 1/1991 | Ichimiya | 229/103.1 |
| 5,054,631 | 10/1991 | Robbins, III | 229/103.1 |
| 5,078,286 | 1/1992 | Hashimoto | 215/1 A |
| 5,188,283 | 2/1993 | Gu | 229/103.1 |
| 5,280,844 | 1/1994 | Kaufman et al. | 220/710 |

FOREIGN PATENT DOCUMENTS

| | | | |
|---|---|---|---|
| 978901 | 1/1965 | United Kingdom | 229/103.1 |

*Primary Examiner*—Gary E. Elkins
*Attorney, Agent, or Firm*—Timmons & Kelly

[57] ABSTRACT

A drinking tube extends through a receptacle having a top, a bottom, and at least one side. The upper portion of the tube is located outside the receptacle, within a recessed portion of the receptacle, and the end of the tube is sealed by a seal, such as break-away tab. A connector connects the seal and the upper end the tube to the receptacle. A secondary connector located along the upper portion of the tube also connects the upper end of the tube to the receptacle. In one embodiment, the connector is broken to allow the seal and the upper portion of the drinking tube to be moved away from the receptacle. The seal is then removed from the tube, to open the tube and the receptacle. In a second embodiment, the upper end of the tube is broken away from the seal to open the tube and to allow the upper end of the tube to be moved away from the receptacle.

15 Claims, 1 Drawing Sheet

BEVERAGE CONTAINER

BACKGROUND OF THE INVENTION

1. Field of the Invention

This invention relates in general to beverage containers, such as cans, bottles, or paperboard boxes. In particular, the invention relates to beverage containers having built-in drinking tubes.

2. Description of Related Art

Most children enjoy drinking beverages from a bottle or a paperboard box through a drinking tube, such as a straw. However, if a straw is sold in conjunction with a paperboard box, the straws must be attached to the box in some manner. Usually, the straw is placed next to the box, and both are covered with a clear covering. The clear covering is then likely to become litter, along with the straw and the empty box.

In order to overcome this problem, some have attempted to provide beverage containers with built-in drinking tubes. For example, U.S. Pat. No. 3,486,679, issued Dec. 30, 1969, to Pfahler, discloses a beverage container having a built-in drinking tube. The tube has an upper portion and a lower portion. Both portions of the tube are located within the container, when the container is closed. When the container is opened, the upper portion of the tube extends upward out of the container. A closure tab fits over the upper portion of the tube, and attaches the upper portion of the tube to the top of the container. The closure tab is not attached directly to the tube, but the tube slides within the guide sleeve portion of the closure tab. When the closure tab is raised, the tube can be removed from the guide sleeve, or the guide sleeve can be torn to allow removal.

Other methods have also been used to provide a beverage container with a built-in drinking tube. In most cases, the tube is sealed within the container, and are released by opening the top the container.

Some prior art beverage containers have break-away tabs attached across an opening. The tabs can be twisted and removed in order to open the container. The tabs and the containers are sometimes formed integrally of the same material.

There has remained a need for an improved and commercially viable beverage container having a built-in drinking tube, wherein the tube is sealed until released. Also, the container must be simple and inexpensive to manufacture. Further, environmental concerns require that the entire container, including the drinking tube, be easily disposable and recyclable.

SUMMARY OF THE INVENTION

The general object of the invention is to provide a beverage container having a built-in drinking tube, in which the container is opened by removing a seal from the end of the drinking tube. In general, this object is accomplished by a beverage container having a receptacle, a drinking tube, and a break-away tab attached across the opening of the tube for sealing the tube.

The container also has a connector for connecting the tube and the seal to the receptacle. The connector is connected directly to either the seal or to the upper end of the drinking tube. If the connector is connected to the seal, the seal and the tube both break away from the receptacle. The seal is then removed from the tube. If the connector is connected directly to the upper end of the tube, the tube is broken away from the seal and the connector at the same time.

The receptacle has a recessed portion on the top or along one side of the receptacle. The upper end of the tube lies within this recessed portion. When the connector has been broken, the upper end of the tube can be moved out of the recessed portion of the receptacle.

The above, as well as additional objects, features, and advantages of the invention will become apparent in the following detailed description.

DESCRIPTION OF THE PREFERRED EMBODIMENT

Figure 1:
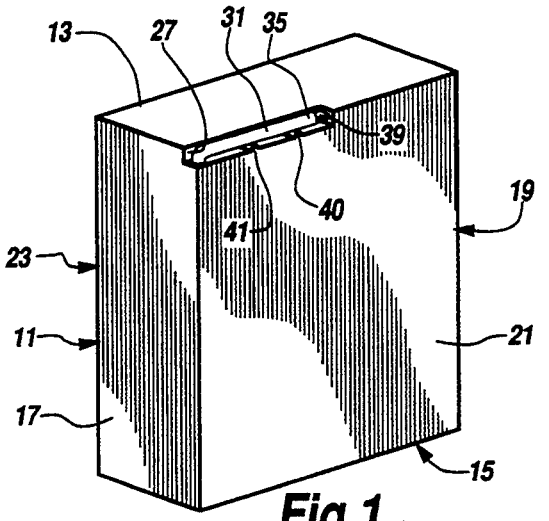
FIG. 1 is a perspective view of one embodiment of the beverage container of the invention.
Figure 2:
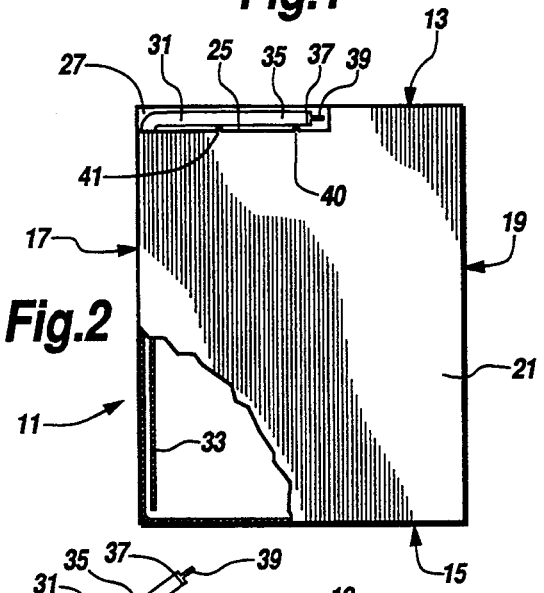
FIG. 2 is a front elevation, partially broken away, of the beverage container shown in FIG. 1, with the upper end of the drinking tube attached to the receptacle.
Figure 3:
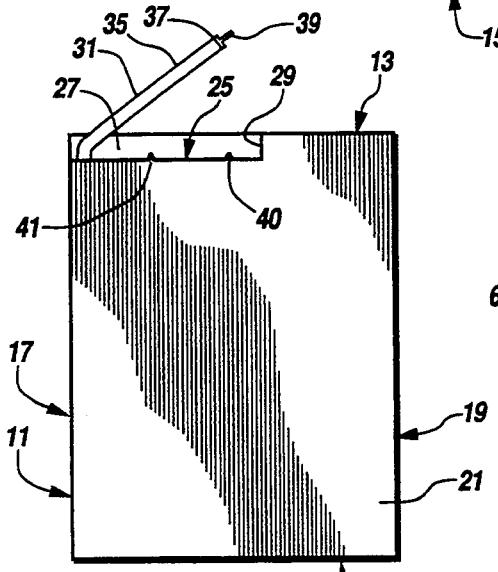
FIG. 3 is a front elevation of the beverage container shown in FIG. 1, with the upper end of the drinking tube and the break-away tab moved away from the receptacle.

The beverage container of the invention is shown and described in two embodiments, the first embodiment being illustrated in FIGS. 1–3. The beverage container of the first embodiment includes a receptacle 11 having a top 13, a bottom 15, and at least one side 17. The receptacle 11 of this first embodiment is a rectangular box, having two sides 17 and 19, a front 21, and a back 23. The invention could also be used in a round bottle, or a box of another shape. The preferred material of the receptacle 11 is plastic, such as polyethylene, but the receptacle 11 could also be made other materials. It is preferable that the material of the container be flexible and elastic.

The first embodiment of the beverage container also has a recessed portion along the upper edge of the front 21 of the receptacle 11. The recessed portion is formed by three surfaces. The first surface 25 is parallel to the top 13 and adjacent to the side 17 and the front 21 of the receptacle 11, but slightly lower than the top 13. The second surface 27 is parallel to the front 21 of the receptacle 11, and adjacent to the top 13 and the side 17 of the receptacle 11. The third surface 29 is parallel to the side 17 and adjacent to the top 13 and the front 21 of the receptacle 11.

The beverage container of the first embodiment also has a drinking tube 31. The lower portion 33 of the drinking tube 31 is located within the receptacle 11, and extends to a point near the bottom 15 of the receptacle 11. The lower portion 33 of the tube 31 is formed integrally with the receptacle 11 from the same material, such as by blow molding.

The drinking tube 31 passes through the receptacle 11 and the upper portion 35 of the tube 31 is located outside the receptacle 11. The upper portion 35 of the tube 31 lies within the recessed portion of the receptacle 11, and extends across the top 13 of the receptacle 11. Thus, the opening 37 of the tube 31 is located in the recessed portion of the receptacle 11, near the top 13 of the receptacle 11. It is preferred that the entire drinking tube 31 be formed integrally with the receptacle 11 from the same material, such as by blow molding.

A seal 39, such as a break-away tab 39, is attached across the opening 37 of the upper portion 35 of the tube 31. The tab 39 is formed integrally with the drinking tube 31 and the receptacle 11 from the same material, such as by blow molding, and seals the opening 37.

In this first embodiment, a connector 40 connects the upper portion 35 of the tube 31 to the outer surface of the receptacle 11. A secondary connector 41 is located about half way between the opening 37 of the tube 31 and the point where the tube 31 enters the receptacle 11. The secondary connector 41 connects the upper portion 35 of the tube 31 to the outer surface of the receptacle 11. The connector 40 and the secondary connector 41 can be easily broken, and then the upper portion 35 of the tube 31 can be moved away from the receptacle 11, as shown in FIG. 3.

After the upper portion 35 of the tube 31 has been moved away from the receptacle 11, the break-away tab 39 can be removed. The material of the tab 39 is slightly denser than the material in the drinking tube 31, so that the connection between the tab 39 and the drinking tube 31 can be easily broken by twisting the tab 39.

The tube 31 is no longer sealed, and the beverage can be consumed by sipping on the upper end 35 of the drinking tube 31. The sides 17 and 19 of the receptacle 11 will collapse slightly to allow the beverage to flow smoothly through the tube 31. The container can also be used by pouring or squirting the beverage out the tube 31 by squeezing the sides 17 and 19 of the receptacle 11.

Figure 4:
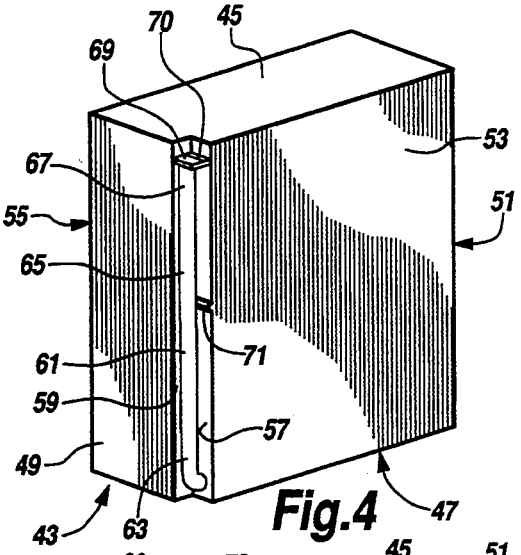
FIG. 4 is a perspective view of another embodiment of the beverage container of the invention.
Figure 5:
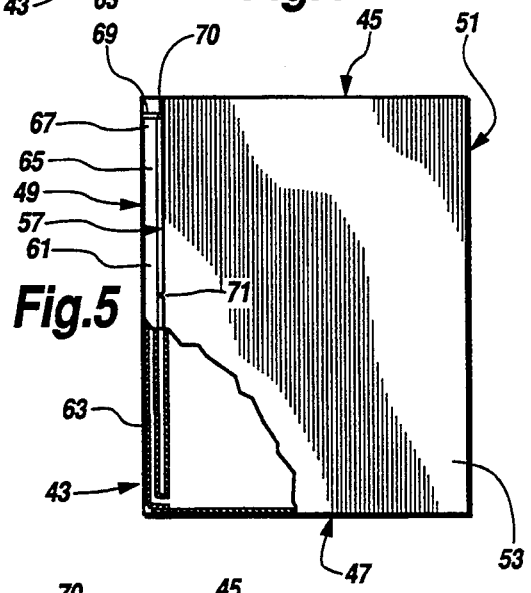
FIG. 5 is a front elevation, partially broken away, of the beverage container shown in FIG. 4, with the upper end of the drinking tube attached to the receptacle.
Figure 6:
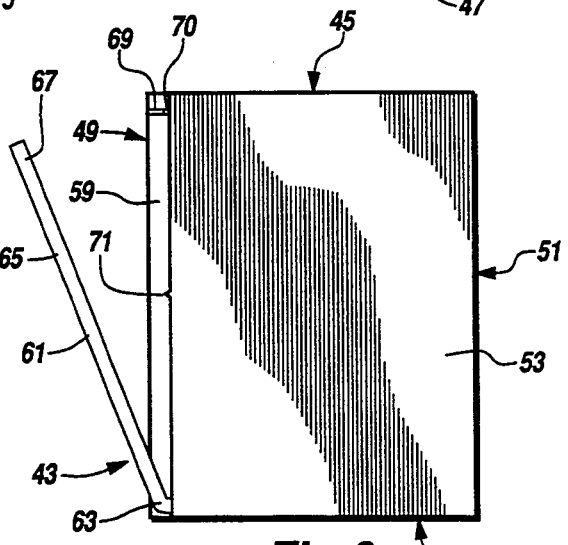
FIG. 6 is a front elevation of the beverage container shown in FIG. 4, with the upper end of the drinking tube moved away from the receptacle.

The second embodiment of the beverage container of the invention is illustrated in FIGS. 4–6. The beverage container the second embodiment includes a receptacle 43 having a top 45, a bottom 47, and at least one side 49. The receptacle 43 of the second embodiment is a rectangular box, having two sides 49 and 51, a front 53, and a back 55. The invention could also be used in a round bottle, or a box of another shape. The preferred material of the receptacle 43 is plastic, such as polyethylene, but the receptacle 43 could also be made of other materials.

The second embodiment of the beverage container has a recessed portion along one vertical edge of the front 53 of the receptacle 43. The recessed portion is formed by two surfaces. The first surface 57 is parallel to the side 49 and adjacent to the front 53 the receptacle 43. The second surface 59 is parallel to the front 53 of the receptacle 43, and adjacent to the side 49 of the receptacle 43.

The beverage container of the second embodiment also has a drinking tube 61. The lower portion 63 of the drinking tube 61 is located outside the receptacle 43, and ends at an opening to the receptacle 43 at a point near the bottom 47 of the receptacle 43.

The upper portion 65 of the tube 61 is also located outside the receptacle 43, and lies within the recessed portion of the receptacle 43. The tube 61 extends upward to a point near the top 45 of the receptacle 43. Thus, the upper opening 67 of the tube 61 is located within the recessed portion of the receptacle 43, near the top 45 of the receptacle 43. It is preferred that the drinking tube 61 formed integrally with the receptacle 11 from the same material, such as by blow molding.

A seal 69 is attached across the opening 67 of the upper portion 65 of the tube 61. The seal 69 is formed integrally with the drinking tube 61 and the receptacle 43 from the same material, and seals the opening 67 of the tube 61.

In this second embodiment, a connector 70 connects the seal 69 to the outer surface of the receptacle 11, and thus indirectly connects the upper portion 65 of the tube 61 to the receptacle 43. The material of the seal 69 is slightly denser than the material in the drinking tube 61, so that the connection between the seal 69 and drinking tube 61 can be easily broken.

A secondary connector 71 is located about half way between the opening 67 of the tube 61 and the point where the tube 61 enters the receptacle 43. The secondary connector 71 connects the upper portion 65 of the tube 61 to the outer surface of the receptacle 43. When the upper portion 65 of the tube 61 has been broken away from the seal 69, the secondary connector 71 can be easily broken.

After the seal 69 and the connector 71 have been broken, the upper portion 65 of the tube 61 can be moved away from the receptacle 43, as shown in FIG. 6. The tube 61 is no longer sealed, and the beverage can be consumed by sucking on the upper end 65 of the drinking tube 61. The sides 49 and 51 of the receptacle 43 will collapse slightly to allow the beverage to flow smoothly through the tube 31. The container can also be used by pouring or squirting the beverage out of the tube 61 by squeezing the sides 49 and 51 of the receptacle 43.

The beverage container of the invention has several advantages over the prior art. The container is a self-contained drinking and pouring container, capable of high speed mass production at low cost. The unitary construction saves costs of manufacturing, and enables the entire container, including the drinking tube, to be easily disposed of and recycled.

The invention has been described in only two embodiments. It should be apparent to those skilled in the art that the invention is not so limited, but is susceptible to various changes and modifications without departing from the spirit of the invention.

I claim:

1. A beverage container, comprising:

a receptacle for containing a beverage, the receptacle having an outer surface and an interior defined by a top, a bottom, and at least one side;

a drinking tube having a lower portion and an upper portion, the upper portion having an opening at one end of the upper portion, and the lower portion being located within the interior of the receptacle and having an opening to the interior of the receptacle at a point near the bottom of the receptacle;

a seal attached across the opening of the upper portion of the drinking tube for sealing the drinking tube, wherein the seal can be broken to open the tube, providing access to the interior of the receptacle only through the tube; and a connector for connecting the upper portion of the drinking tube to the outer surface of the receptacle, wherein the drinking tube can be broken away from the connector to allow the upper portion of the tube to be moved away from the receptacle.

2. A beverage container, as recited in claim 1, wherein the upper portion of the drinking tube is located outside the receptacle.

3. A beverage container, as recited in claim 1, further comprising a secondary connector for connecting the upper portion of the drinking tube to the outer surface of the receptacle.

4. A beverage container, as recited in claim 1, wherein the receptacle has a recessed portion and the upper portion of the drinking tube is located within the recessed portion when the upper portion of the drinking tube is connected to the receptacle.

5. A beverage container, as recited in claim 1, wherein the receptacle, the drinking tube, and the seal are all formed integrally from the same material.

6. A beverage container, comprising:

a receptacle for containing a beverage, the receptacle having an outer surface and an interior defined by a top, a bottom, and at least one side;

a drinking tube having a lower portion and an upper portion, the upper portion extending across the top of the receptacle and having an opening at one end of the upper portion, and the lower portion being located within the interior of the receptacle and having an opening to the interior of the receptacle at a point near the bottom of the receptacle;

a break-away tab attached across the opening of the upper portion of the drinking tube for sealing the drinking tube, wherein the tab can be broken off of the tube to open the tube, providing access to the interior of the receptacle only through the tube; and a connector for connecting the break-away tab to the outer surface of the receptacle, wherein the break-away tab can be broken away from the connector to allow the upper portion of the tube and the break-away tab to be moved away from the receptacle.

7. A beverage container, as recited in claim 6, wherein the upper portion of the drinking tube is located outside the receptacle.

8. A beverage container, as recited in claim 6, further comprising a secondary connector for connecting the upper portion of the drinking tube to the outer surface of the receptacle.

9. A beverage container, as recited in claim 9, wherein the receptacle has a recessed portion and the upper portion of the drinking tube is located within the recessed portion when the upper portion of the drinking tube is connected to the receptacle.

10. A beverage container, as recited in claim 6, wherein the receptacle, the drinking tube, and the break-away tube are all formed integrally from the same material.

11. A beverage container, comprising:

a receptacle for containing a beverage, the receptacle having an outer surface and an interior defined by a top, a bottom, and at least one side;

a drinking tube having a lower portion and an upper portion, the upper portion having an opening at one end of the upper portion, and the lower portion having an opening to the interior of the receptacle at a point near the bottom of the receptacle;

a seal attached across the opening of the upper portion of the drinking tube for sealing the drinking tube, wherein the seal can be broken to open the tube, providing access to the interior of the receptacle only through the tube; and a connector for permanently connecting the seal to the outer surface of the receptacle, wherein the drinking tube can be broken away from the seal to allow the upper portion of the tube to be moved away from the seal as the seal remains connected to the receptacle.

12. A beverage container, as recited in claim 11, wherein the upper portion of the drinking tube is located outside the receptacle.

13. A beverage container, as recited in claim 11, further comprising a secondary connector for connecting the upper portion of the drinking tube to the outer surface of the receptacle.

14. A beverage container, as recited in claim 11, wherein the receptacle has a recessed portion and the upper portion of the drinking tube is located within the recessed portion when the upper portion of the drinking tube is connected to the receptacle.

15. A beverage container, as recited in claim 11, wherein the receptacle, the drinking tube, and the seal are all formed integrally from the same material.

* * * * *